US011326478B2

(12) United States Patent
Cho et al.

(10) Patent No.: US 11,326,478 B2
(45) Date of Patent: May 10, 2022

(54) STRUT STRUCTURE WITH STRIP FOR EXHAUST DIFFUSER AND GAS TURBINE HAVING THE SAME

(71) Applicant: DOOSAN HEAVY INDUSTRIES & CONSTRUCTION CO., LTD., Changwon-si (KR)

(72) Inventors: Seung Hyun Cho, Changwon-si (KR); Ik Sang Lee, Seoul (KR)

( * ) Notice: Subject to any disclaimer, the term of this patent is extended or adjusted under 35 U.S.C. 154(b) by 0 days.

(21) Appl. No.: 17/092,666

(22) Filed: Nov. 9, 2020

(65) Prior Publication Data

US 2021/0254508 A1 Aug. 19, 2021

(30) Foreign Application Priority Data

Dec. 13, 2019 (KR) ..... 10-2019-0167192

(51) Int. Cl.
*F01D 25/30* (2006.01)

(52) U.S. Cl.
CPC ..... *F01D 25/30* (2013.01); *F05D 2220/32* (2013.01); *F05D 2240/12* (2013.01)

(58) Field of Classification Search
CPC ... F01D 25/30; F05D 2220/32; F05D 2240/12
See application file for complete search history.

(56) References Cited

U.S. PATENT DOCUMENTS 3,012,709 A * 12/1961 Schnell ..... F04D 29/681 416/236 R
3,193,185 A * 7/1965 Erwin ..... F01D 5/145 415/193
4,128,363 A * 12/1978 Fujikake ..... F04D 19/002 416/236 A
4,706,910 A * 11/1987 Walsh ..... B64C 21/10 244/130

(Continued)

FOREIGN PATENT DOCUMENTS

EP 2679793 A1 1/2014
EP 3543463 A1 9/2019

(Continued)

OTHER PUBLICATIONS

European Search Report dated Apr. 13, 2021.
KR Office Action dated Nov. 17, 2021.

*Primary Examiner* — J. Todd Newton
*Assistant Examiner* — Theodore C Ribadeneyra
(74) *Attorney, Agent, or Firm* — Harvest IP Law, LLP

(57) ABSTRACT

A strut structure with a strip for an exhaust diffuser of a gas turbine and a gas turbine having the same are provided. The strut structure with a strip for an exhaust diffuser of a gas turbine is configured to include a plurality of struts disposed along an outer circumference of a diffuser body disposed on a central side of the exhaust diffuser, and one or more strips formed on the strut, wherein an exhaust gas passing through the strut flows along the strip from a leading edge of the strut to alleviate a separated flow phenomenon, and wherein if the (Continued)

exhaust gas enters the strip, corner vortices are formed on the leading edge of the strut, and if the exhaust gas flows along the strip, streamwise vortices are formed to alleviate a pressure loss of the exhaust gas.

16 Claims, 14 Drawing Sheets

(56) References Cited

U.S. PATENT DOCUMENTS 4,907,765 A * 3/1990 Hirschel ..... F15D 1/0035 244/200
5,058,837 A * 10/1991 Wheeler ..... B64C 23/06 244/200.1
5,337,568 A * 8/1994 Lee ..... F01D 5/18 60/755
6,213,711 B1 * 4/2001 Muller ..... F01D 5/145 415/191
6,345,791 B1 * 2/2002 McClure ..... B63B 1/34 244/200
8,210,482 B2 * 7/2012 Miller ..... B64C 23/06 244/200.1
8,469,313 B2 * 6/2013 Dong ..... H01L 31/0236 244/130
8,794,927 B2 * 8/2014 Vassilicos ..... F15D 1/10 416/228
9,670,901 B2 * 6/2017 Obrecht ..... F03D 1/0675
10,422,249 B2 * 9/2019 Takeda ..... F01D 25/30
10,450,868 B2 * 10/2019 Jones ..... F01D 5/187
10,465,525 B2 * 11/2019 Jones ..... B23K 26/342
10,569,365 B2 * 2/2020 Song ..... B23K 26/0604
10,851,817 B2 * 12/2020 Van Nesselrooij ..... F15D 1/00
11,047,238 B2 * 6/2021 Guegan ..... F01D 5/141
11,156,099 B2 * 10/2021 Jain ..... F04D 29/544
2009/0013532 A1 * 1/2009 Wood ..... F01D 5/141 29/889.7
2011/0008174 A1 * 1/2011 Ireland ..... B64C 23/06 416/223 R
2011/0056179 A1 * 3/2011 Orosa ..... F01D 25/305 60/39.5
2012/0061522 A1 * 3/2012 Sullivan ..... B64C 3/14 244/198
2013/0091865 A1 * 4/2013 Nanda ..... F01D 25/30 60/805
2013/0164488 A1 6/2013 Wood
2014/0060062 A1 3/2014 Subbareddyar
2014/0096500 A1 * 4/2014 Chengappa ..... F01D 5/145 60/39.5
2014/0137533 A1 * 5/2014 Subramaniyan ..... F01D 25/30 60/39.5
2014/0301860 A1 * 10/2014 Ramm ..... F01D 5/145 416/231 R
2015/0086339 A1 * 3/2015 Orosa ..... F01D 17/16 415/148
2016/0146468 A1 * 5/2016 Gao ..... F23R 3/12 60/742
2016/0194076 A1 * 7/2016 Van Merksteijn ..... B63B 1/34 428/156
2016/0348537 A1 * 12/2016 Akturk ..... F01D 5/143
2017/0137116 A1 * 5/2017 Ireland ..... F04D 29/324
2017/0145863 A1 * 5/2017 Nanda ..... F01D 25/30
2017/0159442 A1 * 6/2017 Velazquez, Jr. ..... F01D 5/141
2017/0167510 A1 * 6/2017 Berschback ..... F01D 9/04
2017/0342862 A1 * 11/2017 Vijayan ..... F01D 9/02
2018/0135424 A1 * 5/2018 Barker ..... F02C 3/04
2018/0328229 A1 * 11/2018 Tanimura ..... F01D 25/30
2018/0328230 A1 * 11/2018 Ikeguchi ..... F01D 25/30
2018/0363466 A1 * 12/2018 Gallier ..... F01D 25/12

FOREIGN PATENT DOCUMENTS

JP 2015503694 A 2/2015
WO 9841739 A1 9/1998
WO 2005100752 A1 10/2005

* cited by examiner

[FIG. 1]
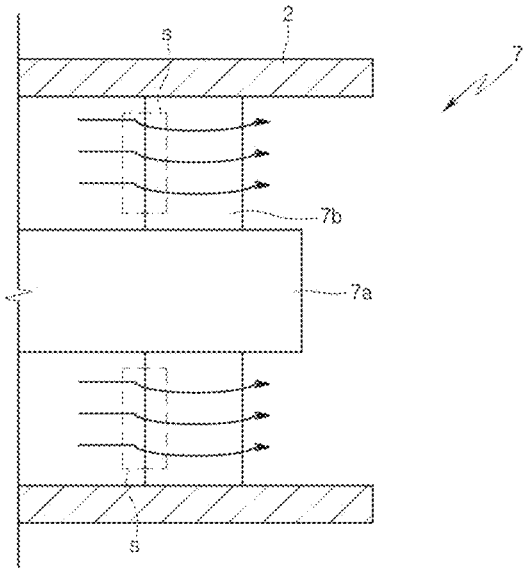
Related Art

[FIG. 2]
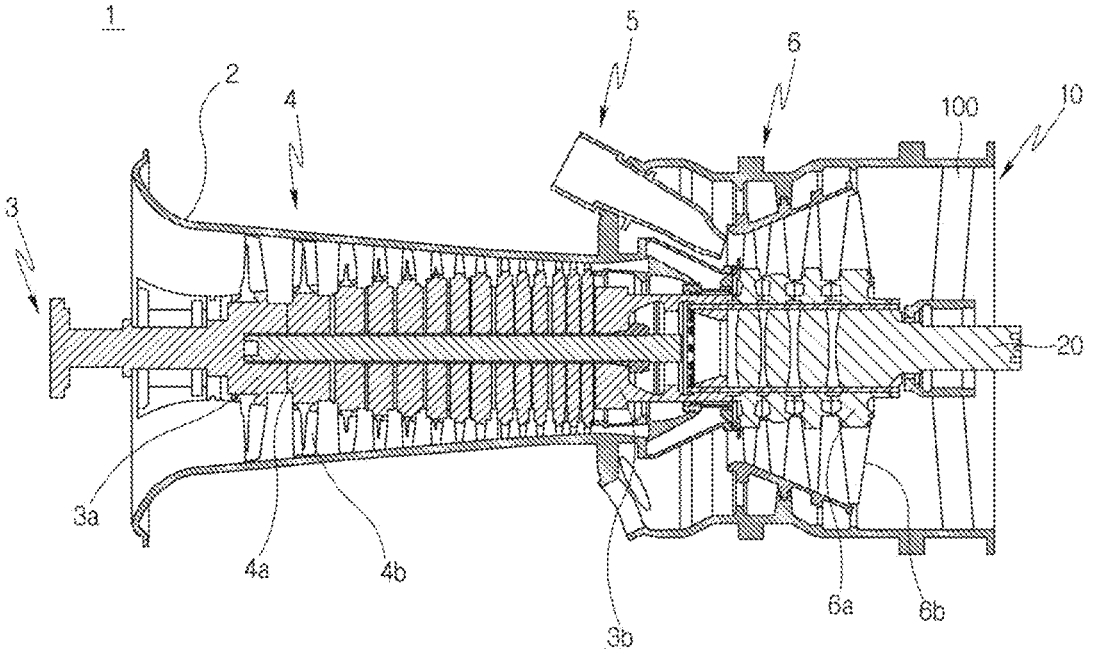

[FIG. 3]
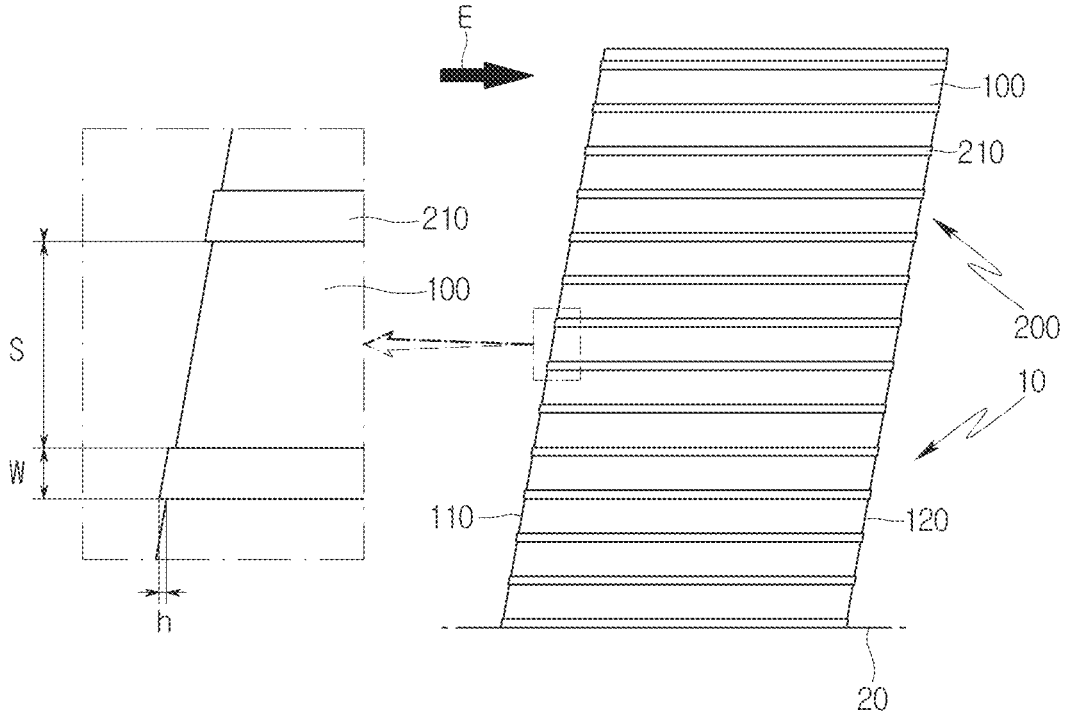

[FIG. 4]
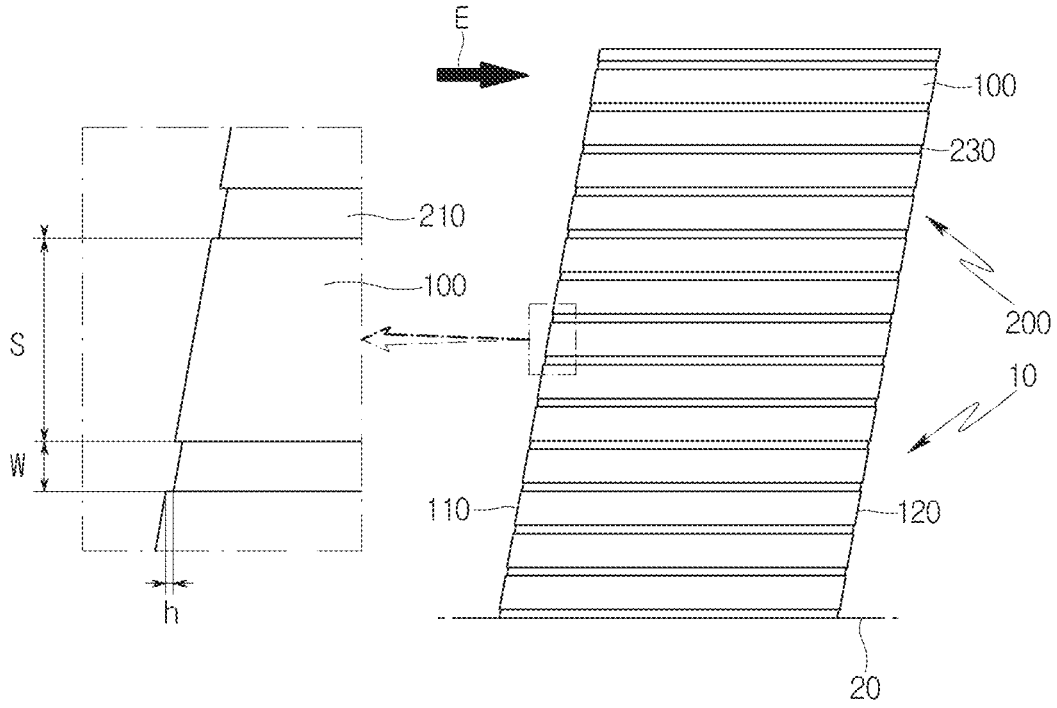

[FIG. 5]
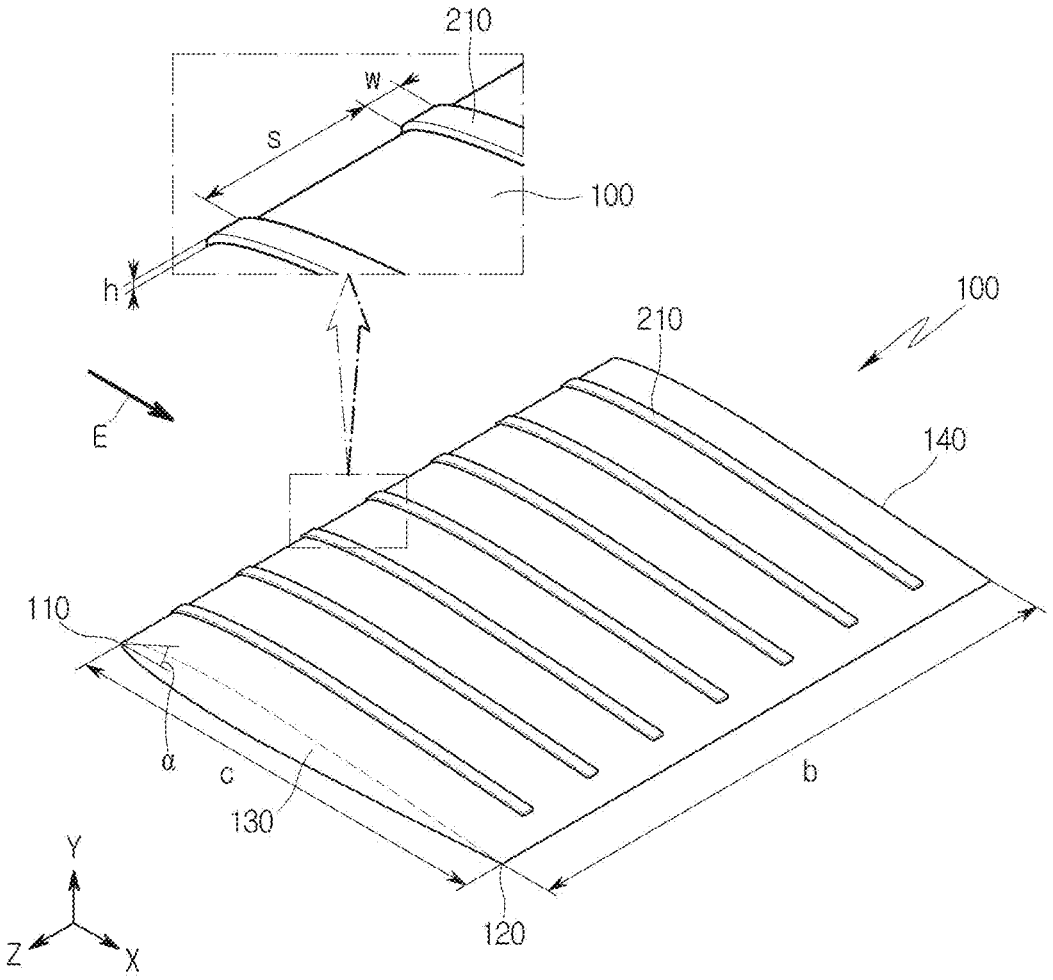

[FIG. 6]
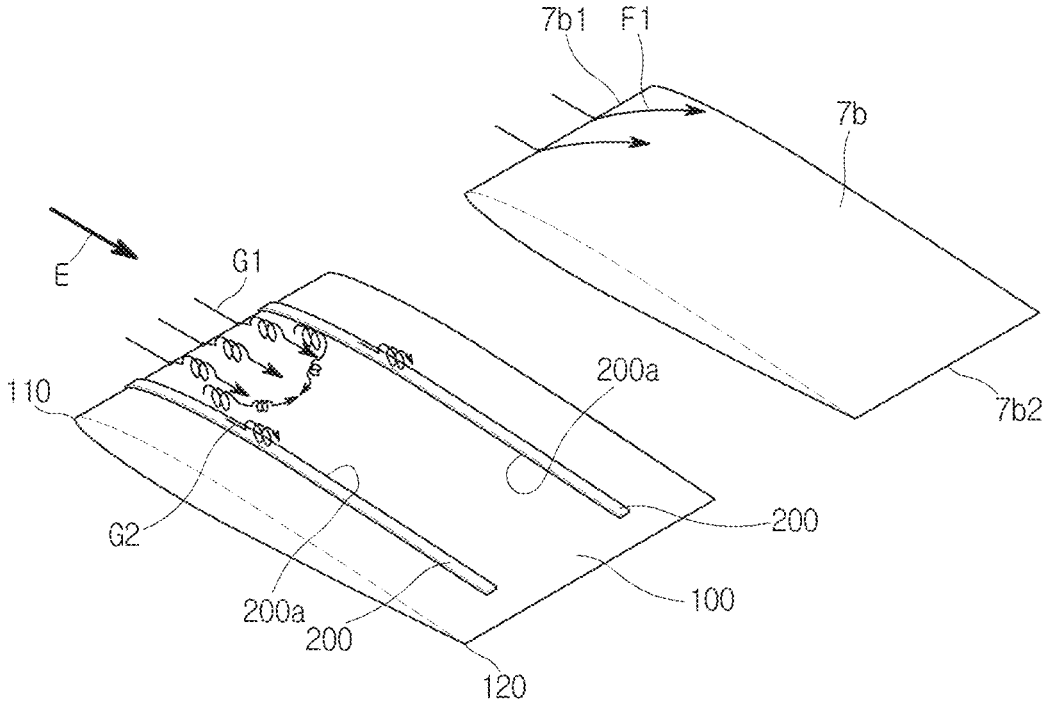

[FIG.7]
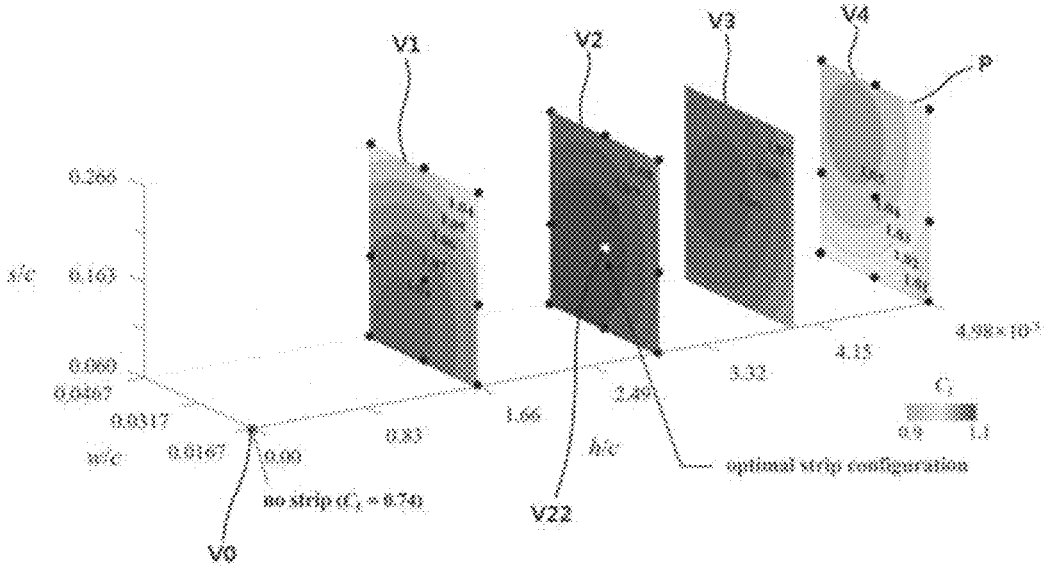

[FIG.8]
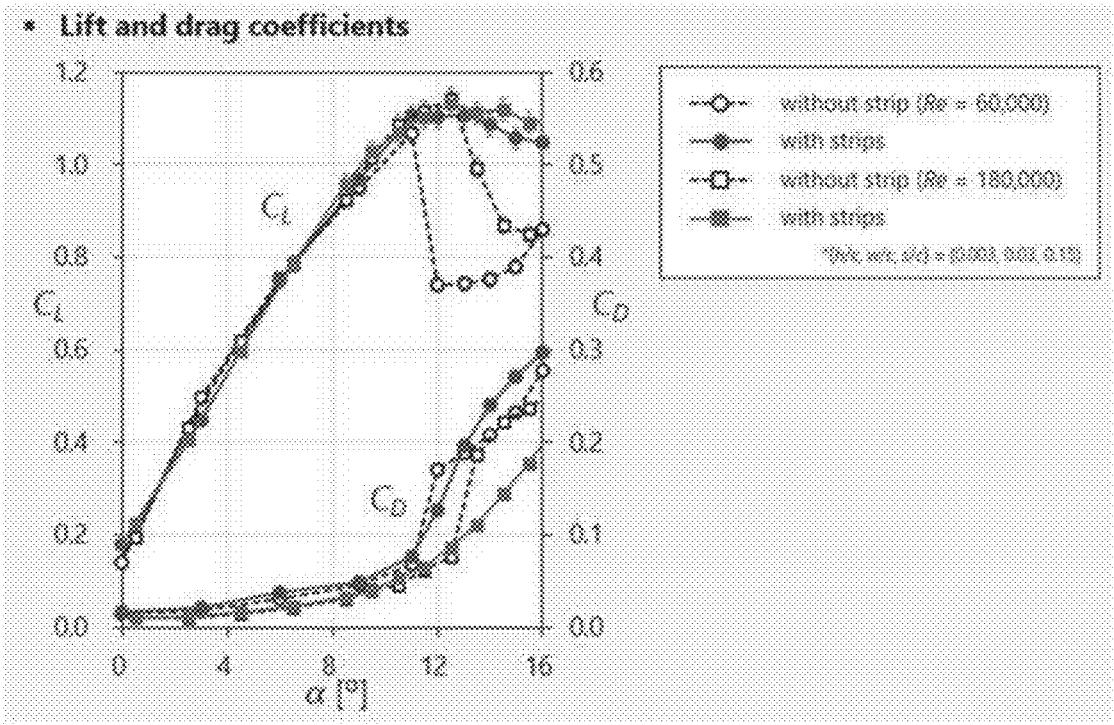

[FIG.9]
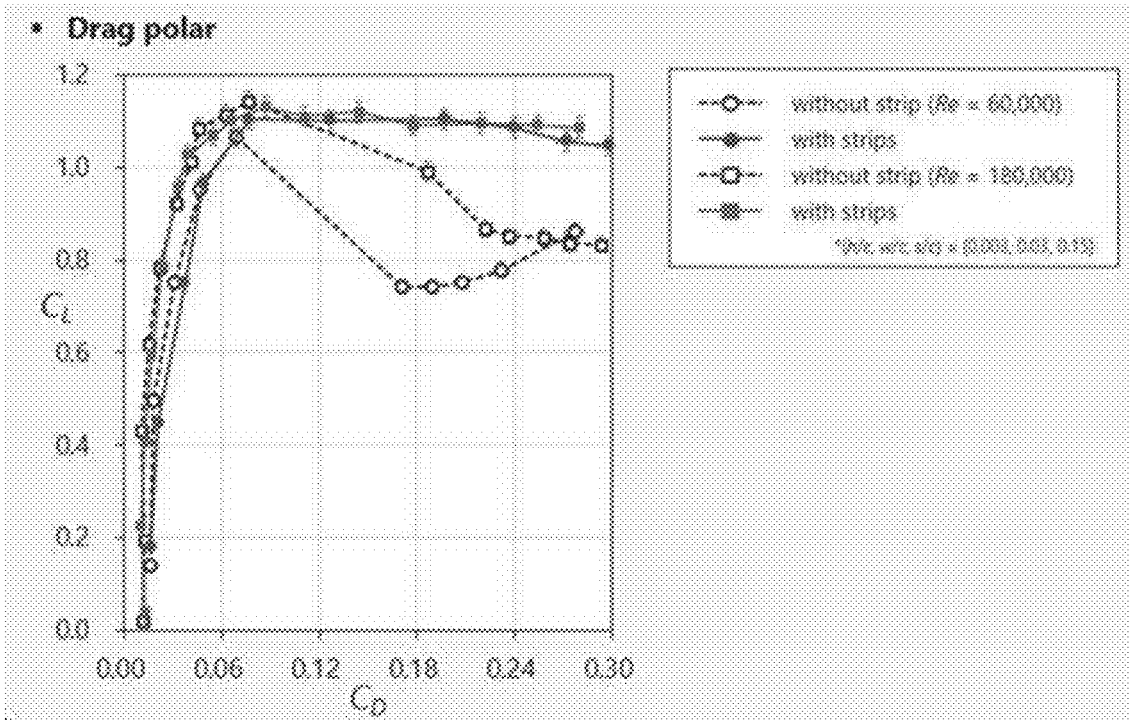

[FIG. 10]
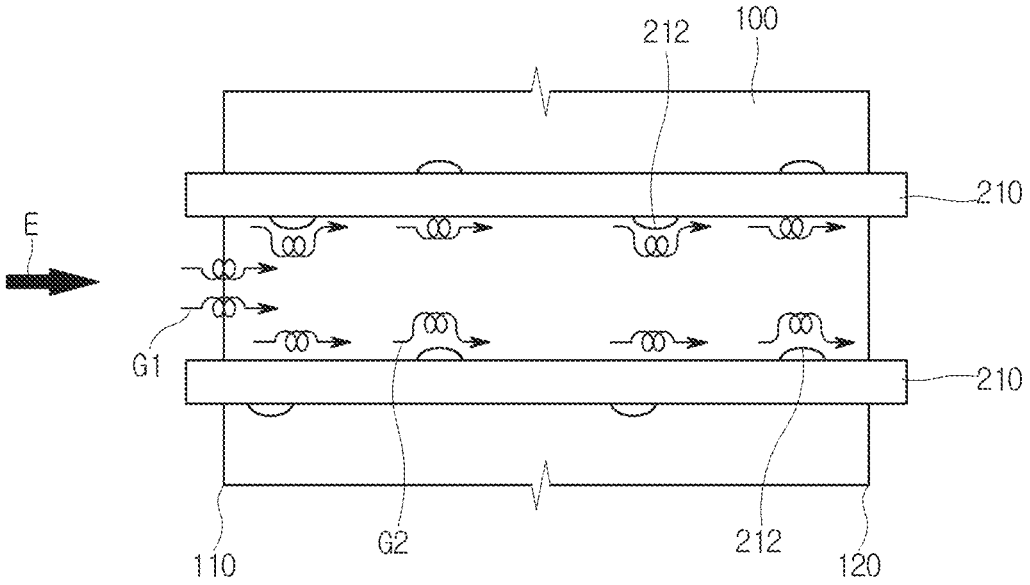

[FIG. 11]
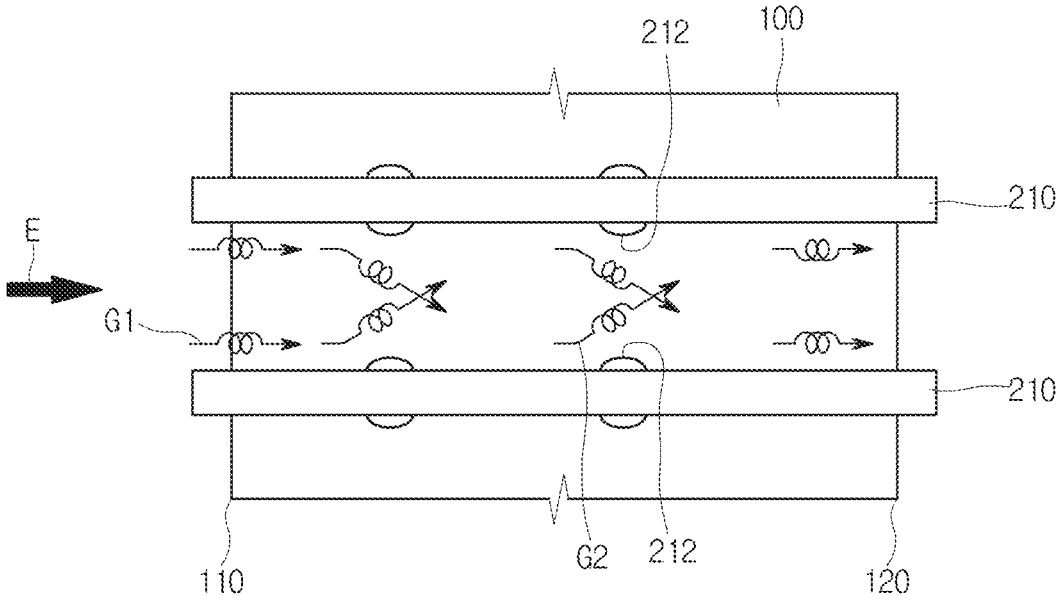

[FIG. 12]
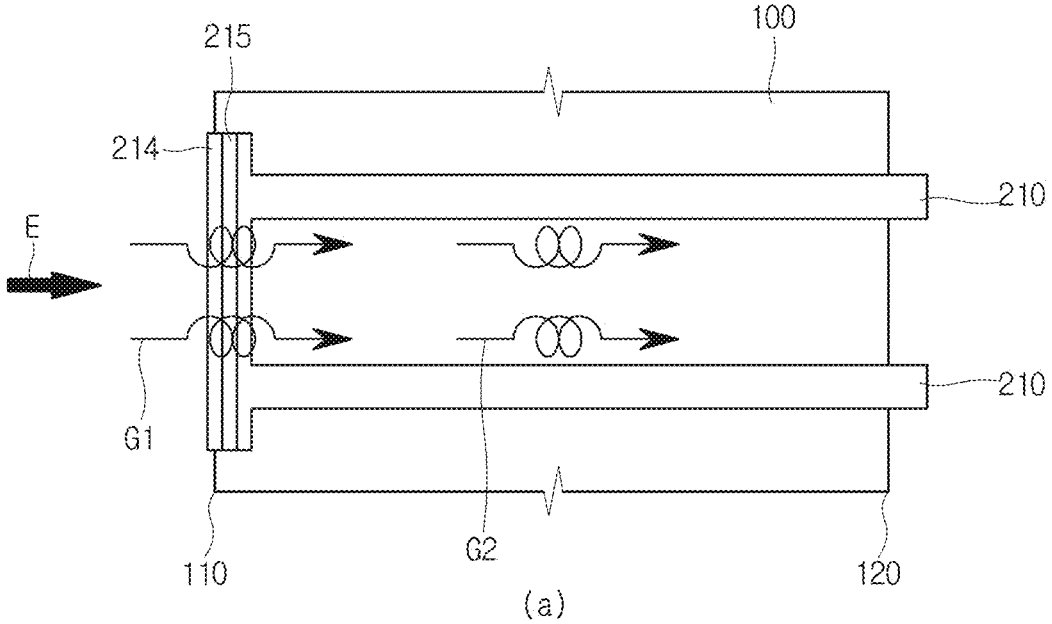
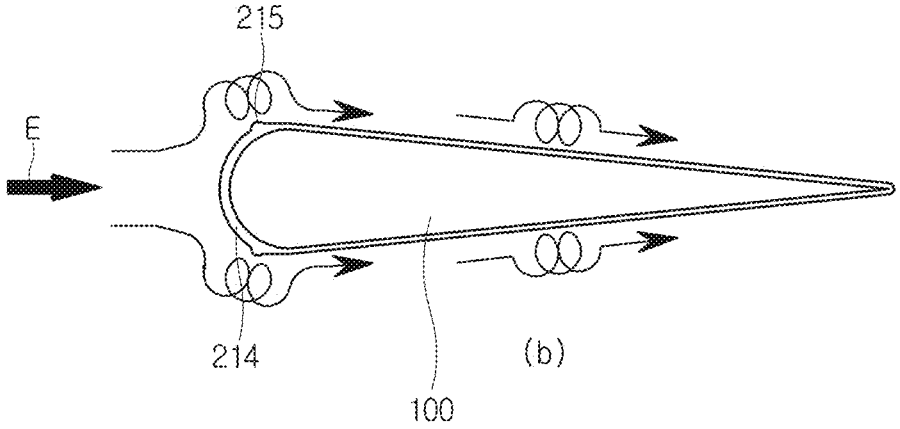

[FIG. 13]
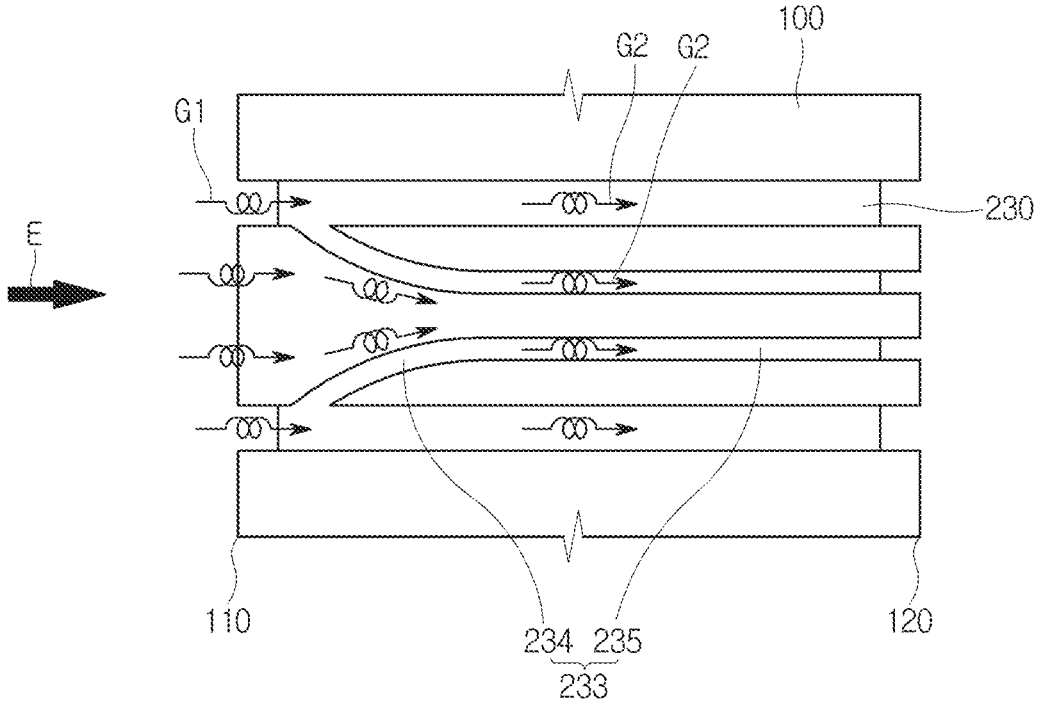

[FIG. 14]
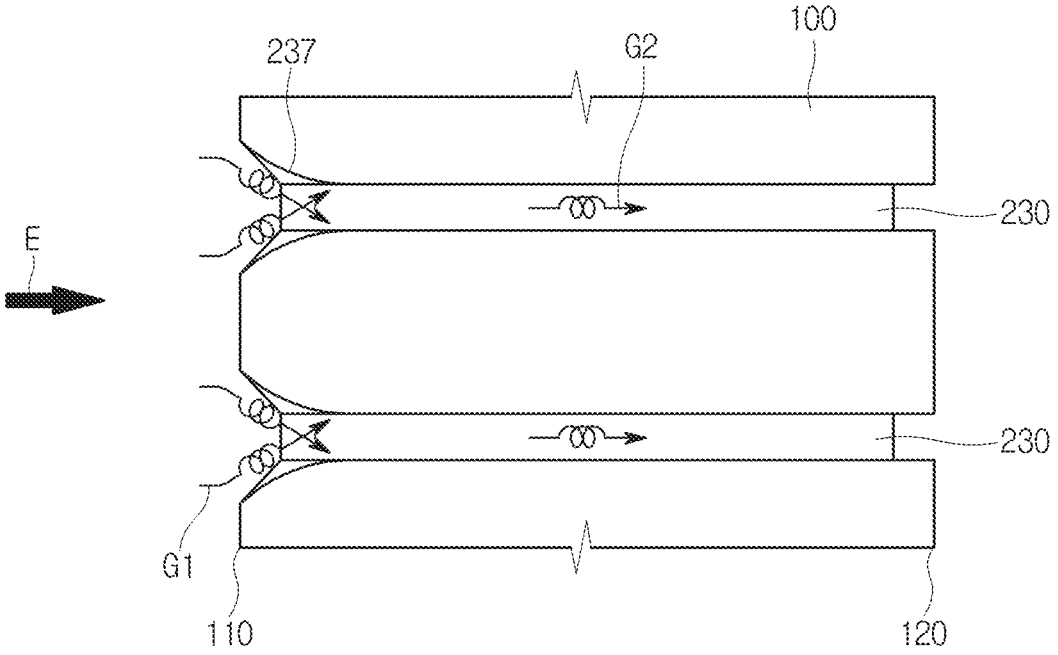

STRUT STRUCTURE WITH STRIP FOR EXHAUST DIFFUSER AND GAS TURBINE HAVING THE SAME

CROSS-REFERENCE TO RELATED APPLICATION

This application claims priority to Korean Patent Application No. 10-2019-0167192, filed on Dec. 13, 2019, the disclosure of which is incorporated by reference herein in its entirety.

BACKGROUND

Field

Apparatuses and methods consistent with exemplary embodiments relate to a strut structure of an exhaust diffuser, and more particularly, to a strut structure of an exhaust diffuser, which has strips disposed in a plurality of columns on a strut for an exhaust diffuser of a gas turbine in a flow direction of an exhaust gas, thereby alleviating a separated flow phenomenon of the exhaust gas passing through the strut, and forms several vortices, thereby alleviating a pressure loss.

Description of the Related Art

A turbine is a machine for converting the energy owned by an operation fluid such as water, gas, or steam into mechanical work, and generally refers to a turbo-type machine which has multiple blades or vanes placed on a circumference of a rotational body and exhales a steam or a gas thereto to rotate the blades or the vanes at a high speed with an impulse force or a reaction force.

The turbine is classified into a gas turbine using high-temperature and high-pressure combustion gas as the operation fluid, a steam turbine using steam as the operation fluid, or the like.

The gas turbine includes a housing, a rotor rotatably provided inside the housing, a compressor configured to receive a rotational force from the rotor to compress air, a combustor configured to mix fuel with the air compressed by the compressor and ignite the fuel and the air to generate a combustion gas, and a turbine configured to obtain a rotational force from the combustion gas generated by the combustor to rotate the rotor.

Further, the combustion gas passing through the turbine passes through an exhaust diffuser and is discharged to the outside of the gas turbine.

FIG. 1 illustrates one form of a strut 7*b* disposed on a related art exhaust diffuser 7. Referring to FIG. 1, a diffuser body 7*a* is disposed to protrude outward from a rear portion of a casing 2 of a gas turbine, and a plurality of struts 7*b* are disposed to protrude radially along an outer circumference of the diffuser body 7*a*.

The exhaust gas is discharged to the outside while passing through the plurality of struts 7*b*, and when the exhaust gas passes through the strut 7*b*, there occurs a problem in that a separated flow occurs in a leading edge region S of the strut 7*b*, thereby losing a pressure inside the exhaust diffuser.

SUMMARY

Aspects of one or more exemplary embodiments provide a strut structure of an exhaust diffuser, which has struts disposed in a plurality of columns on a strut for an exhaust diffuser of a gas turbine in a flow direction of an exhaust gas, thereby alleviating a separated flow phenomenon of the exhaust gas passing through the strut, and forms several vortices, thereby alleviating a pressure loss.

Additional aspects will be set forth in part in the description which follows and, in part, will become apparent from the description, or may be learned by practice of the exemplary embodiments.

According to an aspect of an exemplary embodiment, there is provided a strut structure with a strip for an exhaust diffuser of a gas turbine including: a plurality of struts disposed along an outer circumference of a diffuser body disposed on a central side of the exhaust diffuser; and one or more strips formed on the strut, wherein an exhaust gas passing through the strut flows along the strip from a leading edge of the strut to alleviate a separated flow phenomenon, and wherein if the exhaust gas enters the strip, corner vortices are formed on the leading edge of the strut, and if the exhaust gas flows along the strip, streamwise vortices are formed to alleviate a pressure loss of the exhaust gas.

The strip may be formed on the strut in parallel to a flow direction of the exhaust gas.

The strip may be a projection type strip protruding outward from the strut.

The projection type strip may have a rectangular cross-sectional shape with respect to the flow direction of the exhaust gas.

If a length from the leading edge of the strut to a trailing edge thereof is designated as c, and a height from a diffuser body connection part of the strut to an outer end thereof is designated as b, a height h of the projection type strip may be formed at a ratio of a range of $0 \leq h/c \leq 0.005$.

A width w of the projection type strip may be formed at a ratio of a range of $0.017 \leq w/c \leq 0.05$.

The projection type strips may be disposed on the strut in a plurality of columns, and a spacing S between neighboring projection type strips among the projection type strips disposed in the plurality of columns may be formed at a ratio of a range of $0.05 \leq s/c \leq 0.27$.

The strut structure with the strip for the exhaust diffuser may further include a sub projection disposed in the longitudinal direction of the projection type strip to strengthen the occurrence of the streamwise vortices of the exhaust gas.

The projection type strips may be disposed on the strut in a plurality of columns, and the sub projections may be disposed at irregular locations between neighboring strips among the projection type strips.

The projection type strips may be disposed on the strut in a plurality of columns, and the sub projections may be disposed to face each other at locations corresponding to each other between neighboring strips among the projection type strips.

The sub projection may have a rounded shape.

A vortex induction block connected to the projection type strip on the leading edge of the strut may be disposed to strengthen the occurrence of the corner vortices of the exhaust gas.

The vortex induction block may include one or more bending portions.

The bending portion may have a rounded step shape.

The strip may be a groove type strip recessed inward from the strut.

The groove type strip may have a rectangular cross-sectional shape with respect to the flow direction of the exhaust gas.

The strut structure with the strip for the exhaust diffuser may further include a sub groove connected to the groove type strip on the strut and disposed in the flow direction of the exhaust gas to strengthen the occurrence of the streamwise vortices of the exhaust gas.

The sub groove may include: a curved portion connected to the groove type strip; and a linear portion connected to the curved portion and disposed in the flow direction of the exhaust gas.

The strut structure with the strip for the exhaust diffuser may further include an expansion cutout portion connected to the groove type strip on the leading edge of the strut and expanding more than a width of the groove type strip to strengthen the occurrence of the corner vortices of the exhaust gas on the leading edge of the strut.

According to an aspect of another exemplary embodiment, there is provided a gas turbine including: a compressor section configured to compress air; a combustor configured to mix the compressed air with fuel and to combust the air and fuel mixture; a turbine section configured to produce power with the combustion gas discharged from the combustor; and an exhaust diffuser configured to discharge the combustion gas passing through the turbine section to the outside as an exhaust gas, the exhaust diffuser having a strut formed with the strip of claim 1.

The present disclosure may form the strip on the strut for the exhaust diffuser, thereby alleviating the separated flow phenomenon of the exhaust gas on the leading edge of the strut.

Further, when the exhaust gas flows to the strut, the corner vortices are formed on the leading edge of the strut, and the streamwise vortices are formed in the longitudinal direction of the strip, thereby alleviating the pressure loss inside the exhaust diffuser.

This may ultimately improve the efficiency of the gas turbine.

BRIEF DESCRIPTION OF THE DRAWINGS

The above and other aspects will become more apparent from the following description of the exemplary embodiments with reference to the accompanying drawings, in which:

FIG. 1 is a diagram illustrating a related art strut structure of an exhaust diffuser of a gas turbine;

FIG. 2 is a diagram illustrating a general structure of a gas turbine;

FIG. 3 is a diagram illustrating a structure in which a projection type strip is formed on a strut for an exhaust diffuser according to an exemplary embodiment;

FIG. 4 is a diagram illustrating a structure in which a groove type strip is formed on the strut for the exhaust diffuser according to an exemplary embodiment;

FIG. 5 is a diagram illustrating a length c and height b of the strut, a height h and width w of the strip, and a spacing S between the strips according to an exemplary embodiment;

FIG. 6 is a diagram comparing an occurrence of a separated flow phenomenon and an occurrence of corner vortices and streamwise vortices according to whether the strip is formed on the strut;

FIG. 7 is a diagram illustrating a degree of a lift coefficient according to ratio relationships between s/c, w/c, and h/c;

FIG. 8 is a diagram comparing lift coefficients and drag coefficients according to whether the strip is formed at a specific Reynolds number (Re; unit-less);

FIG. 9 is a diagram comparing drag polars according to whether the strip is formed at the specific Reynolds number (Re; unit-less);

FIG. 10 is a diagram illustrating a projection type strip according to another exemplary embodiment;

FIG. 11 is a diagram illustrating a projection type strip according to another exemplary embodiment;

FIG. 12 is a diagram illustrating a projection type strip according to another exemplary embodiment;

FIG. 13 is a diagram illustrating a groove type strip according to another exemplary embodiment; and FIG. 14 is a diagram illustrating a groove type strip according to another exemplary embodiment.

DETAILED DESCRIPTION

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Hereinafter, exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

FIG. 2 is a diagram illustrating a general structure of a gas turbine according to an exemplary embodiment.

Referring to FIG. 2, a gas turbine 1 may include a casing 2 forming an appearance, a compressor section 4 configured to compress air, a combustor 5 configured to combust the compressed air, a turbine section 6 configured to generate power using the combustion gas, an exhaust diffuser 10 configured to discharge an exhaust gas, and a rotor 3 connecting the compressor section 4 to the turbine section 6 to transfer a rotational power.

Based on a flow direction of gas (e.g., compressed air or combustion gas), the compressor section 4 is disposed at an upstream side of the gas turbine 1 and the turbine section 6 is disposed at a downstream side of the gas turbine 1. The combustor 5 is disposed between the compressor section 4 and the turbine section 6. Outside air is thermodynamically introduced into the compressor section 4 to go through an adiabatic compression process. The compressed air is introduced into the combustor 5 and mixed with fuel to go through an isobaric combustion process, and the combustion gas is introduced into the turbine section 6 to go through an adiabatic expansion process.

The compressor section 4 includes vanes and rotors. The turbine section 6 includes vanes and rotors. The compressor vanes and rotors are arranged in a multi-stage arrangement along the flow direction of compressed air. The turbine vanes and rotors are arranged in a multi-stage arrangement along the flow direction of combustion gas. The compressor section 4 is designed such that an internal space is gradually decreased in size from a front stage to a rear stage so that air drawn into the compressor section 4 can be compressed. On the contrary, the turbine section 6 is designed such that an internal space is gradually increased in size from a front stage to a rear stage so that combustion gas received from the combustor 5 can expand.

A torque tube 3*b* configured to transfer the rotational torque generated by the turbine section 6 to the compressor section 4 is provided between the compressor section 4 and the turbine section 6.

Each of the compressor rotors includes a compressor rotor disk 4*a* and a compressor blade 4*b* fastened to the compressor rotor disk. The compressor section 4 includes a plurality of compressor rotor disks 4*a*, and respective compressor rotor disks 4*a* are coupled to each other by a tie rod 3*a* to prevent axial separation in an axial direction.

The compressor rotor disks 4*a* are arranged in the axial direction with the tie rods 3*a* extending through central portions of the compressor rotor disks 4*a*. Adjacent compressor rotor disks are arranged such that opposing surfaces thereof are in tight contact with each other by being tightly fastened by the tie rod so that the adjacent compressor rotor disks cannot rotate relative to each other.

A plurality of blades 4*b* (or referred to as buckets) are radially coupled to an outer circumferential surface of each of the compressor rotor disk 4*a*. Each of the blades 4*b* includes a dove tail portion by which the blade 4*b* is fastened to the compressor rotor disk 4*a*.

A fastening method of the dove tail portion is classified into a tangential type and an axial type. The fastening method may be selected according to a structure of a gas turbine to be used, and may have dovetail shape or fir-tree shape. In some cases, the compressor blade 4*b* may be fastened to the compressor rotor disk 4*a* by using other fastening devices, such as a key or a bolt.

A plurality of vanes (or referred to as nozzles) are fixedly arranged on an inner circumferential surface of the compressor section 4, and rows of the vanes are arranged between rows of the blades 4*b*. While the compressor rotor disks 4*a* rotate along with a rotation of the tie rod 3*a*, the vanes fixed to the casing do not rotate. The vanes guide the flow of compressed air moved from front-stage blades 4*b* of the compressor rotor disk 4*a* to rear-stage blades 4*b* of the compressor rotor disk 4*a*.

The tie rod 3*a* is disposed to penetrate center portions of the plurality of compressor rotor disks 4*a*, and has one end fastened into the compressor rotor disk 4*a* located at the foremost stage of the compressor section 4, and the other end fixed to the torque tube 3*b*.

It is understood that the tie rod 3*a* is not limited to the example illustrated in FIG. 2, and may be changed or vary according to one or more other exemplary embodiments. For example, there are three types of tie rods: a single-type in which one tie rod may penetrate the central portions of the compressor discs; a multi-type in which multiple tie rods may be arranged circumferentially; and a complex type in which the single-type and the multi-type may be combined.

The combustor 5 mixes the introduced compressed air with fuel to produce a high-temperature and high-pressure combustion gas having high energy, and increases the temperature of the combustion gas to a heat-resistant temperature limit at which the combustor and turbine components are able to withstand in an isobaric combustion process.

A plurality of combustors constituting a combustion system of the gas turbine may be arranged within the casing 2 formed in a cell form.

The high-temperature and high-pressure combustion gas supplied from the combustor 5 flows into the turbine section 6 and expands while passing through the inside of the turbine section 6, thereby applying impulse or reaction forces to the rotational vane of the turbine section 6 to generate mechanical energy.

A portion of the mechanical energy is supplied to the compressor section 4 via the torque tube 3*b*, and a remaining portion is used to drive a generator to produce power.

In the turbine section 6, a plurality of stators and rotors are configured to be alternately disposed and formed within a vehicle compartment, and the rotor is driven by the combustion gas to rotationally drive an output shaft to which the generator is connected.

The turbine section 6 basically is similar to the compressor section 4 in structure. That is, the turbine section 6 includes a plurality of turbine rotors similar to the compressor rotors. Each of the turbine rotors includes a turbine rotor disk 6*a* and a turbine blade 6*b* fastened to the turbine rotor disk. The turbine section 6 includes a plurality of turbine rotor disks 6*a*, and respective turbine rotor disks 6*a* are coupled to each other.

A plurality of turbine blades 6*b* (or referred to as buckets) are radially disposed. Each of the turbine blade 6*b* may also be coupled to the turbine rotor disk 6*a* in the dove tail method.

A plurality of vanes (or referred to as nozzles) are fixedly arranged on an inner circumferential surface of the turbine section 6, and rows of the vanes are arranged between rows of the blades 6*b*.

In the gas turbine having the above-described structure, the introduced air is compressed in the compressor section 4, combusted by the combustor 5, then moved to the turbine section 6 to be power-generated and driven, and discharged to the atmosphere through an exhaust diffuser 10.

The exhaust diffuser 10 may have a diffuser body 20 disposed therein, the diffuser body 20 with a cylindrical shape protruding outward from an inner central side of the exhaust diffuser, and a plurality of struts 100 may be radially disposed on an outer circumference of the diffuser body 20.

Here, the torque tube 3*b*, the compressor rotor disk 4*a*, the compressor blade 4*b*, the turbine rotor disk 6*a*, the turbine blade 6*b*, and the tie rod 3*a*, which are rotation components may be collectively referred to as the rotor 3 or a rotating body. Further, the casing 2 and the vane which are non-rotation components may be collectively referred to as the stator or a fixing body.

FIG. 3 is a diagram illustrating a structure in which a projection type strip 210 is formed on the strut 100 for the exhaust diffuser 10 according to an exemplary embodiment, and FIG. 5 is a diagram illustrating a length c and a height b of the strut 100, a height h and a width w of a strip 200, and a spacing S between the strips 200. FIG. 6 is a diagram comparing an occurrence of a separated flow F1 phenomenon and an occurrence of corner vortices G1 and streamwise vortices G2 according to whether the strip 200 is formed on the strut 100, FIG. 7 is a diagram illustrating the degree of a lift coefficient according to the ratio relationships between s/c, w/c, and h/c.

Referring to FIG. 3, the structure of the strut 100 with the strip 200 for the exhaust diffuser according to an exemplary embodiment may include the plurality of struts 100 disposed along the outer circumference of the diffuser body 20 disposed on the central side of the exhaust diffuser 10 of the gas turbine and one or more strips 200 formed on the strut 100. For example, the strip 200 may be disposed on the strut 100 in a plurality of columns.

Further, the strip 200 may be formed on the strut 100 in parallel to the flow direction of an exhaust gas E, and the strip 200 may be in a form of a projection type strip 210 protruding outward from the strut 100.

The projection type strip 210 may have a rectangular cross-sectional shape with respect to the flow direction of the exhaust gas E, though it is understood that other embodiments are not limited thereto and other shapes may be used.

Referring to FIG. 6, in a case in which the strip 200 is not formed, when the exhaust gas E flows in the strut 7*b* having a leading edge 7*b*1 and a trailing edge 7*b*2 and reaches the leading edge 7b1 of the strut 7b, a separated flow F1 phenomenon may occur when the exhaust gas E flows along a curved surface of the strut 7b. Therefore, a pressure inside the exhaust diffuser 10 is reduced, such that a pressure loss may occur.

On the contrary, when the exhaust gas E flows in the strut 100 formed with the strip 200 and reaches the leading edge 110 of the strut 100, the separated flow F1 is suppressed and alleviated by the strip 200.

That is, when entering the leading edge 110 of the strut 100, the exhaust gas E flows between neighboring strips 200, such that corner vortices G1 occur. Due to the occurrence of the corner vortices G1, the exhaust gas E shows an attached flow around the leading edge 110, and the separated flow F1 phenomenon is suppressed.

In addition, when the exhaust gas E flows between the strips 200, a flow resistance due to a friction on a boundary surface 200*a* with the strip 200 is generated, such that streamwise vortices G2 occur. Further, when the streamwise vortices G2 are formed, the exhaust gas E shows the attached flow and the separated flow F1 phenomenon is suppressed.

Due to the placement of the strip 200, the separated flow F1 phenomenon on the strut 100 is suppressed and alleviated, and this may be confirmed through experimental result values illustrated in FIGS. 5 and 7.

Referring to FIG. 5 which illustrates an experimental design criterion of the projection type strip 210, a length from the leading edge 110 of the strut 100 to the trailing edge 120 thereof may be designated as c, and a height from a diffuser body connection part 130 of the strut 100 to an outer end 140 thereof may be designated as b.

Further, a height of the projection type strip 210 may be designated as h, a width thereof may be designated as w, and a spacing between the neighboring projection type strips 210 may be designated as S.

Here, parameters designated based on the experimental results may have the following relationships.

(1) The height h of the projection type strip 210 may be designed at a ratio of a range of $0 \le h/c \le 0.005$.

(2) The width w of the projection type strip 210 may be designed at a ratio of a range of $0.017 \le w/c \le 0.05$.

(3) The spacing S between the neighboring projection type strips 210 among the projection type strips 210 disposed in the plurality of columns may be designed at a ratio of a range of $0.05 \le s/c \le 0.27$.

The aforementioned range values for the height h and width w of the projection type strip 210, and the spacing S between the neighboring projection type strips 210 may be optimal range values derived through the experiment.

Referring to FIG. 7, if the strip 200 was not formed on the strut 100 ($V_0$), a lift coefficient $C_L$ was measured as 0.74. Further, the projection type strip 210 was configured by various design values, and the experiment for the value of the lift coefficient $C_L$ was conducted.

As illustrated in FIG. 7, it may be confirmed that among the experimental design values, the lift coefficient $C_L$ generally maintains a value of 1 or more in four regions $V_1$, $V_2$, $V_3$, $V_4$ indicated on the h/c, w/c, and s/c axes. Here, the maximum lift coefficient $C_L$ was derived up to 1.1 in the region $V_2$.

The optimal design range values in the experimental results were derived by cases in which the height h of the projection type strip 210 was designed at the ratio of the range of $0 \le h/c \le 0.005$, the width w of the projection type strip 210 was designed at the ratio of the range of $0.017 \le w/c \le 0.05$, and the spacing S between the neighboring projection type strips 210 among the projection type strips 210 disposed in the plurality of columns was designed at the ratio of the range of $0.05 \le s/c \le 0.27$.

Each of the values of the h/c, the w/c, and the s/c of the projection type strip 210 at a design value $V_{22}$ at which the maximum lift coefficient $C_L$ was derived up to 1.1 is as follows.

$$(h/c, w/c, s/c) = (0.003, 0.03, 0.15)$$

That is, in the case of having the values of h/c=0.003, w/c=0.03, and s/c=0.15, the maximum lift coefficient $C_L$ was generated, such that optimal ratios of the h/c, the w/c, and the s/c are when being designed as h/c=0.003, w/c=0.03, and s/c=0.15.

A reliability of the optimization result is 99.6%. The experiment in each of the regions $V_1$, $V_2$, $V_3$, $V_4$ was conducted by values at a plurality of points P. The experimental result values show the high reliability, such that if the aforementioned design ratios of the h/c, the w/c, and the s/c are applied, it is possible to prevent the lift coefficient $C_L$ from being reduced by the separated flow F1 on the strut 100.

In FIG. 6, the case in which the separated flow F1 phenomenon is suppressed and alleviated may mean an improvement in the value of the lift coefficient $C_L$ in FIG. 7. That is, as the strip 200 is formed on the strut 100, the separated flow F1 phenomenon is suppressed and alleviated, and as a result, the value of the lift coefficient $C_L$ is improved.

FIG. 8 illustrates an experimental chart comparing the lift coefficients $C_L$ and drag coefficients $C_D$ according to whether the strip 200 is formed at a specific Reynolds number (Re; unit-less).

Referring to FIG. 8, an angle $\alpha$ in the experiment chart may be an entry angle at which the exhaust gas enters the leading edge 110 of the strut 100. The exhaust gas discharged from the turbine section of the gas turbine is discharged to the exhaust diffuser after passing through the rotating turbine blade, such that when the exhaust gas enters the strut 100, a predetermined entry angle is formed with respect to the leading edge 110 of the strut 100.

Here, Re of the experimental chart means a Reynolds number and is a unit-less.

The experimental chart illustrated in FIG. 8 shows that as the value of the entry angle $\alpha$ of the exhaust gas with respect to the leading edge 110 of the strut 100 is increased, the lift coefficient $C_L$ and the drag coefficient $C_D$ generally tends to be increased.

However, if the entry angle $\alpha$ of the exhaust gas exceeds 11° to 12°, it may be confirmed that in the case of the lift coefficient $C_L$, the value of the lift coefficient $C_L$ is rapidly reduced if the strip 200 is not formed. This may mean that the separated flow F1 phenomenon severely occurs.

On the contrary, if the strip 200 is formed, it may be confirmed that the degree at which the value of the lift coefficient $C_L$ is reduced is smooth compared to the case in which the strip 200 is not formed.

That is, as illustrated in FIG. 6, in the case in which the strip 200 is formed, the separated flow F1 phenomenon is suppressed and alleviated, and the corner vortices G1 and the streamwise vortices G2 occur, such that the value of the lift coefficient $C_L$ is not rapidly reduced, smoothly reduced, and maintained, compared to the case in which the strip 200 is not formed.

As the experimental results, it may be confirmed that the case in which the strip 200 is formed has a better characteristic of the lift coefficient $C_L$ than that of the case in which the strip 200 is not formed.

Next, as the value of the entry angle α of the exhaust gas with respect to the leading edge 110 of the strut 100 is increased, the drag coefficient $C_D$ generally tends to be increased.

However, if the entry angle α of the exhaust gas exceeds 11° to 12°, it may be confirmed that the value of the drag coefficient $C_D$ is rapidly increased in the case in which the strip 200 is not formed. This means that the flow resistance is largely generated on the leading edge 110 of the strut 100 according to the increase in the entry angle α.

Further, it may be confirmed that the value of the drag coefficient $C_D$ is generally increased even in the case in which the strip 200 is formed.

The strip 200 in a condition in which the Reynolds number (Re) is 60000 shows relatively large increase in the drag coefficient $C_D$. This is not largely different from that of the case in which the strip 200 is not formed.

On the other hand, the strip 200 in a condition in which the Reynolds number (Re) is 180000 shows a tendency of relatively smooth increase compared to the strip 200 in the condition in which the Reynolds number (Re) is 60000. Further, the case in which the strip 200 is not formed also shows a tendency of smooth increase compared to the increase tendency measured in the cases in which respective Reynolds numbers (Re) are 60000 and 180000.

It may be confirmed that in the case in which the strip 200 is formed on the strut 100, as the Reynolds number (Re) is increased, the drag coefficient $C_D$ may be smoothly increased, thereby alleviating the flow resistance.

As the experimental results, it may be confirmed that as the Reynolds number (Re) has a lager value, the case in which the strip 200 is formed has a better drag coefficient $C_D$ characteristic than that of the case in which the strip 200 is not formed.

FIG. 9 illustrates an experimental chart comparing drag polars according to whether the strip 200 is formed at the specific Reynolds number (Re; unit-less).

Referring to FIG. 9, a horizontal axis of the drag polar indicates the drag coefficient $C_D$, and a vertical axis thereof indicates the lift coefficient $C_L$.

As illustrated in FIG. 9, it may be confirmed that in the case in which the strip 200 is not formed, as the value of the drag coefficient $C_D$ is increased, the value of the lift coefficient $C_L$ is rapidly increased in the beginning, and then the value of the lift coefficient $C_L$ is reduced from a time point when the value of the drag coefficient $C_D$ is 0.06 to 0.08.

This may mean that the separated flow F1 phenomenon remarkably occurs and thus the value of the lift coefficient $C_L$ is reduced, if the leading edge 110 of the strut 100 suffers severe flow resistance in proportion to the drag coefficient $C_D$.

On the contrary, it may be confirmed that in the case in which the strip 200 is formed, if the value of the drag coefficient $C_D$ is increased in the beginning, the value of the lift coefficient $C_L$ is also increased rapidly together, and then even if the value of the drag coefficient $C_D$ is increased to 0.06 or more, the value of the lift coefficient $C_L$ is not reduced and maintains relatively constant value.

This may mean that even if the flow resistance is generated in proportion to the drag coefficient $C_D$ on the leading edge 110 of the strut 100, the attached flow occurs due to the formation of the corner vortices G1 and the streamwise vortices G2, such that the value of the lift coefficient $C_L$ is maintained, thereby alleviating the separated flow F1 phenomenon.

That is, it may be confirmed that based on the experimental results, the case in which the strip 200 is formed prevents the value of the lift coefficient $C_L$ from being remarkably reduced compared to the case in which the strip 200 is not formed.

Further, the drag polar illustrated in FIG. 9 shows a characteristic in which when the strip 200 is formed regardless of the Reynolds number (Re), the value of the lift coefficient $C_L$ remains relatively constant even if the drag coefficient $C_D$ increases.

As a result, when the strip 200 is formed on the strut 100, the value of the lift coefficient $C_L$ remains stable compared to the case in which the strip 200 is not formed on the strut 100, which means that the separated flow F1 phenomenon is suppressed and alleviated on the leading edge 110 of the strut 100, thereby alleviating the pressure loss in the exhaust diffuser 10.

Here, the optimal design range values for deriving the results are as follows.

$$0 \le h/c \le 0.05$$

$$0.017 \le w/c \le 0.05$$

$$0.05 \le s/c \le 0.27$$

Further, the optimal values for generating the value of the maximum lift coefficient $C_L$ are as follows.

h/c=0.003 w/c=0.03 s/c=0.15

FIGS. 10, 11, and 12 illustrate the projection type strip 210 according to another exemplary embodiments.

Referring to FIGS. 10 and 11, the projection type strip 210 according to exemplary embodiments may further include a sub projection 212 disposed in a longitudinal direction of the projection type strip 210 in order to strengthen the occurrence of the streamwise vortices G2 of the exhaust gas E.

In FIG. 10, the sub projections 212 may be disposed at irregular locations between the neighboring strips 200 among the projection type strips 210.

In this case, when the exhaust gas E enters the leading edge 110 of the strut 100, the corner vortices G1 occur on the leading edge 110, and when the exhaust gas E moves in the longitudinal direction of the strip 200, the streamwise vortices G2 occur.

Further, when the exhaust gas E passes through a plurality of sub projections 212 disposed to be spaced apart from each other by a predetermined spacing in the longitudinal direction of the strip 200, that is, the flow direction of the exhaust gas E, the flow direction is changed by the shape of the sub projection 212, such that additional vortices occur on the entry surface of the sub projection 212.

The additional vortices may occur due to the placement of the sub projection 212, thereby additionally alleviating the pressure loss.

In FIG. 11, the sub projections 212 may be disposed to face each other at locations corresponding to each other between the neighboring strips 200 among the projection type strips 210.

In this case, when the exhaust gas E enters the leading edge 110 of the strut 100, the corner vortices G1 occur on the leading edge 110, and when the exhaust gas E moves in the longitudinal direction of the strip 200, the streamwise vortices G2 occur.

Further, when the exhaust gas E passes through a plurality of sub projections 212 disposed to be spaced apart from each other by a predetermined spacing in the longitudinal direction of the strip 200, that is, the flow direction of the exhaust gas E, the flow direction is changed by the shape of the sub projection 212, such that additional vortices occur on the entry surface of the sub projection 212.

Further, due to the additional vortices, the exhaust gas E may be mixed by a pair of sub projections 212 disposed at the locations corresponding to each other on the neighboring strips 200. This may occur when the spacing between the neighboring strips 200 is sufficiently small. The pressure loss may be additionally alleviated by the mix between the vortices.

The sub projection 212 according to exemplary embodiments may be implemented in a rounded shape. This is because when entering the sub projection 212, the exhaust gas E suffers relatively little flow resistance, thereby smoothly inducing occurrence of the vortices.

FIGS. 10 and 11 show that the sub projection 212 is rounded shape, but is not limited thereto, and other shapes capable of inducing the same effect may be considered according to the design specification.

Referring to FIG. 12, a vortex induction block 214 connected to the projection type strip 210 may be disposed on the leading edge 110 of the strut 100 in order to strengthen the occurrence of the corner vortices G1 of the exhaust gas E. Further, one or more bending portions 215 may be formed on the vortex induction block 214.

In this case, when entering the leading edge 110 of the strut 100, the exhaust gas E flows along the bending shape in the bending portion 215 of the vortex induction block 214 and forms additional corner vortices G1. That is, the corner vortices G1 are further strengthened on the leading edge 110, and this may further alleviate the pressure loss inside the exhaust diffuser 10 together with the streamwise vortices G2.

Here, the bending portion 215 may have a rounded step shape, though it is understood that other embodiments are not limited thereto and other shapes capable of inducing the same effect may be considered according to the design specifications.

FIG. 4 is a diagram illustrating a structure in which a groove type strip 230 is formed on the strut 100 for the exhaust diffuser 10 according to an exemplary embodiment, FIG. 13 is a diagram illustrating the groove type strip 230 according to another exemplary embodiment, and FIG. 14 is a diagram illustrating the groove type strip 230 according to another exemplary embodiment.

Referring to FIG. 4, the structure of the strut 100 with the strip 200 for the exhaust diffuser 10 according to an exemplary embodiment may be configured to include a plurality of struts 100 disposed along an outer circumference of a diffuser body 20 disposed on a central side of the exhaust diffuser 10 of the gas turbine and one or more strips 200 formed on the strut 100. The strips 200 may be disposed on the strut 100 in a plurality of columns.

The strip 200 may be formed on the strut 100 in parallel to the flow direction of the exhaust gas E, and the strip 200 may be an exemplary embodiment of a groove type strip 230 recessed inward from the strut 100.

The groove type strip 230 may have a rectangular cross-sectional shape with respect to the flow direction of the exhaust gas E, though it is understood that other embodiments are not limited thereto and other shapes may be used.

FIG. 6 illustrates a comparison of the occurrence of the separated flow F1 phenomenon and the occurrence of the corner vortices G1 and the streamwise vortices G2 according to whether the strip 200 is formed on the strut 100. It is understood that FIG. 6 is expressed by the projection type strip 210, but similar operations for the corner vortices G1 and the streamwise vortices G2 may also be expected and derived from the groove type strip 230.

Referring back to FIG. 4, the design criterion of the groove type strip 230 is suggested. A height and a width of the groove type strip 230 may be designated as h and w, respectively, and a spacing between neighboring projection type strips 210 may be designated as S.

In this case, as illustrated in FIG. 5, a length from the leading edge 110 of the strut 100 to the trailing edge 120 thereof may be designated as c, and a height from the diffuser body connection part 130 of the strut 100 to the outer end 140 thereof may be designated as b.

Here, parameters designated based on the experimental results illustrated in FIG. 7 may be designed by the following relationships.

It is understood that FIG. 7 is the experiment about the projection type strip 210, but in terms of deriving the similar effect, the similar criterion for the range value of the projection type strip 210 may also be applied to the range value of the groove type strip 230. However, it may be determined as other range values based on the experimental results.

The height h of the groove type strip 230 may be designed at a ratio of a range of $0 \le h/c \le 0.005$.

The width w of the groove type strip 230 may be designed at a ratio of a range of $0.017 \le w/c \le 0.05$.

The spacing S between the neighboring groove type strips 230 among the groove type strips 230 disposed in the plurality of columns may be designed at a ratio of a range of $0.05 \le s/c \le 0.27$.

As the aforementioned range values for the height h and width w of the groove type strip 230, and the spacing S between the neighboring groove type strips 230, similar optimal range values will be able to be adopted based on the experimental result values of the projection type strip 210.

Here, the contents for the lift coefficient $C_L$, the drag coefficient $C_D$, and the drag polar illustrated in FIGS. 7 and 9 refer to the aforementioned contents.

As a result, the ratio values of h/c=0.003, w/c=0.03, and s/c=0.15 may be adopted and designed as optimal values even in the case of the groove type strip 230 with reference to the experimental results of the projection type strip 210. However, the optimal values may be changed according to final experimental results.

Meanwhile, referring to FIG. 13, the groove type strip 230 according to another exemplary embodiment may further include a sub groove 233 connected to the groove type strip 230 on the strut 100 and disposed in the flow direction of the exhaust gas E in order to strengthen the occurrence of the streamwise vortices G2 of the exhaust gas E.

The sub groove 233 may be configured to include a curved portion 234 connected to the groove type strip 230 and a linear portion 235 connected to the curved portion 234 and disposed in the flow direction of the exhaust gas E.

If the exhaust gas E flowing to the strut 100 enters the groove type strip 230, the corner vortices G1 occur, and while flowing along the inside of the groove type strip 230, the streamwise vortices G2 occur due to the friction with the boundary surface of the strip 200.

Further, a part of the exhaust gas E flowing along the inside of the groove type strip 230 may bypass and flow to the curved portion 234 of the sub groove 233, and then flow along the linear portion 235. The streamwise vortices G2 occur due to the friction with the boundary surface between the curved portion 234 and the linear portion 235.

If the exhaust gas E flowing between the neighboring groove type strips 230 passes through the sub groove 233, the streamwise vortices G2 occur due to a height step with the sub groove 233.

That is, as the sub groove 233 is formed, the exhaust gas E passing through the strut 100 causes an effect of generally strengthening the streamwise vortices G2, thereby alleviating the pressure loss inside the exhaust diffuser 10.

Referring to FIG. 14, the groove type strip 230 according to another exemplary embodiment may be configured to include an expansion cutout portion 237 that is connected to the groove type strip 230 on the leading edge 110 of the strut 100, and extends more than a width of the groove type strip 230 to strengthen the occurrence of the corner vortices G1 of the exhaust gas E on the leading edge 110 of the strut 100.

In this case, the exhaust gas E entering the strut 100 is mixed while flowing toward the groove type strip 230 along the expansion cutout portion 237 on the leading edge 110 of the strut 100.

Here, the corner vortices G1 are strengthened by the mix between the corner vortices G1 on the leading edge 110 itself and the exhaust gas E collected by the change in the flow direction.

This alleviates the pressure loss inside the exhaust diffuser 10. Thereafter, the exhaust gas E flowing along the inside of the groove type strip 230 forms the streamwise vortices G2 due to the friction with the boundary surface of the groove type strip 230.

As described above, according to various exemplary embodiments of the strut structure with the strip for the exhaust diffuser, it is possible to generate the corner vortices G1 and the streamwise vortices G2 on the strut 100 and alleviate the separated flow F1 phenomenon, thereby alleviating the pressure loss inside the exhaust diffuser 10.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A strut structure with a strip for an exhaust diffuser of a gas turbine comprising:

a plurality of struts disposed along an outer circumference of a diffuser body disposed on a central side of the exhaust diffuser; and one or more strips formed on the strut, wherein an exhaust gas passing through the strut flows along the strip from a leading edge of the strut to alleviate a separated flow phenomenon, wherein if the exhaust gas enters the strip, corner vortices are formed on the leading edge of the strut, and if the exhaust gas flows along the strip, streamwise vortices are formed to alleviate a pressure loss of the exhaust gas, wherein the strip is formed on the strut in parallel to a flow direction of the exhaust gas, wherein the strip is a projection type strip protruding outward from the strut, and wherein the strut structure with the strip further comprises a sub projection disposed in a longitudinal direction of the projection type strip to strengthen the occurrence of the streamwise vortices of the exhaust gas.

2. The strut structure with the strip for the exhaust diffuser of claim 1, wherein the projection type strip has a rectangular cross-sectional shape with respect to the flow direction of the exhaust gas.

3. The strut structure with the strip for the exhaust diffuser of claim 2, wherein if a length from the leading edge of the strut to a trailing edge thereof is designated as c, and a height from a diffuser body connection part of the strut to an outer end thereof is designated as b, a height h of the projection type strip is formed at a ratio of a range of $0.001 \leq h/c \leq 0.005$.

4. The strut structure with the strip for the exhaust diffuser of claim 3, wherein a width w of the projection type strip is formed at a ratio of a range of $0.017 \leq w/c \leq 0.05$.

5. The strut structure with the strip for the exhaust diffuser of claim 4, wherein the projection type strips are disposed on the strut in a plurality of columns, and wherein a spacing s between neighboring projection type strips among the projection type strips disposed in the plurality of columns is formed at a ratio of a range of $0.05 \leq s/c \leq 0.27$.

6. The strut structure with the strip for the exhaust diffuser of claim 1, wherein the projection type strips are disposed on the strut in a plurality of columns, and wherein the sub projections are disposed at irregular locations between neighboring strips among the projection type strips.

7. The strut structure with the strip for the exhaust diffuser of claim 1, wherein the projection type strips are disposed on the strut in a plurality of columns, and wherein the sub projections are disposed to face each other at locations corresponding to each other between neighboring strips among the projection type strips.

8. The strut structure with the strip for the exhaust diffuser of claim 1, wherein the sub projection has a rounded shape.

9. The strut structure with the strip for the exhaust diffuser of claim 1, wherein a vortex induction block connected to the projection type strip on the leading edge of the strut is disposed to strengthen the occurrence of the corner vortices of the exhaust gas.

10. The strut structure with the strip for the exhaust diffuser of claim 9, wherein the vortex induction block comprises one or more bending portions.

11. The strut structure with the strip for the exhaust diffuser of claim 10, wherein the bending portion has a rounded step shape.

12. A gas turbine comprising:

a compressor section configured to compress air;

a combustor configured to mix the compressed air with fuel and to combust the air and fuel mixture;

a turbine section configured to produce power with the combustion gas discharged from the combustor; and an exhaust diffuser configured to discharge the combustion gas passing through the turbine section to the outside as an exhaust gas, the exhaust diffuser having a strut formed with the strip of claim 1.

13. A strut structure with a strip for an exhaust diffuser of a gas turbine comprising:

a plurality of struts disposed along an outer circumference of a diffuser body disposed on a central side of the exhaust diffuser; and one or more strips formed on the strut, wherein an exhaust mas passing through the strut flows along the strip from a leading edge of the strut to alleviate a separated flow phenomenon, wherein if the exhaust as enters the strip, corner vortices are formed on the leading edge of the strut, and if the exhaust gas flows along the strip, streamwise vortices are formed to alleviate a pressure loss of the exhaust gas, wherein the strip is formed on the strut in parallel to a flow direction of the exhaust, wherein the strip is a groove type strip recessed inward from the strut, and wherein the strut structure with the strip further comprises a sub groove connected to the groove type strip on the strut and disposed in the flow direction of the exhaust gas to strengthen the occurrence of the streamwise vortices of the exhaust gas.

14. The strut structure with the strip for the exhaust diffuser of claim 13, wherein the groove type strip has a rectangular cross-sectional shape with respect to the flow direction of the exhaust gas.

15. The strut structure with the strip for the exhaust diffuser of claim 13, wherein the sub groove comprises:

a curved portion connected to the groove type strip; and a linear portion connected to the curved portion and disposed in the flow direction of the exhaust gas.

16. The strut structure with the strip for the exhaust diffuser of claim 13, further comprising: an expansion cutout portion connected to the groove type strip on the leading edge of the strut and expanding more than a width of the groove type strip to strengthen the occurrence of the corner vortices of the exhaust gas on the leading edge of the strut.

* * * * *